US005438354A

United States Patent [19]

Genovese

[11] Patent Number: 5,438,354

[45] Date of Patent: Aug. 1, 1995

[54] START-OF-SCAN AND END-OF-SCAN OPTICAL ELEMENT FOR A RASTER OUTPUT SCANNER IN AN ELECTROPHOTOGRAPHIC PRINTER

[75] Inventor: Frank C. Genovese, Fairport, N.Y.

[73] Assignee: Xerox Corporation, Stamford, Conn.

[21] Appl. No.: 226,426

[22] Filed: Apr. 12, 1994

Related U.S. Application Data

[63] Continuation of Ser. No. 850,737, Mar. 13, 1992, abandoned.

[51] Int. Cl.[6] ..... B41J 2/435

[52] U.S. Cl. ..... 347/256

[58] Field of Search ..... 346/1.1, 76 L, 107 R, 346/108, 160; 347/256, 259, 258, 241, 243

[56] References Cited

U.S. PATENT DOCUMENTS 4,178,064 12/1979 Mrdjen .
4,279,002 7/1981 Rider ..... 358/257
4,692,877 9/1987 Byerly et al. ..... 364/514
4,804,981 2/1989 Prakash et al. ..... 346/160
4,866,459 9/1989 Tokita et al. ..... 346/108
5,043,744 8/1991 Fantuzzo et al. ..... 346/108

OTHER PUBLICATIONS

UK Patent Application 2 229 281 A, Tomohiro Nakajima, Sep. 19, 1990, FIGS. 1–10 and pp. 1–14.

*Primary Examiner*—Mark J. Reinhart
*Attorney, Agent, or Firm*—Robert Hutter

[57] ABSTRACT

An optical element for the transmission of a light beam moving in a scan direction in an electrophotographic printer provides real-time feedback to monitor the motion of the scan. A member elongated in the scan direction is adapted for the transmission of light therethrough in a direction transverse to the scan direction. An optical pattern along a portion of the member in the scan direction includes at least one surface for the non-transmission of light passing transverse to the scan direction.

13 Claims, 3 Drawing Sheets

START-OF-SCAN AND END-OF-SCAN OPTICAL ELEMENT FOR A RASTER OUTPUT SCANNER IN AN ELECTROPHOTOGRAPHIC PRINTER

This is a continuation of application Ser. No. 07/850,737, filed Mar. 13, 1992, now abandoned.

FIELD OF THE INVENTION

The present invention relates to a raster output scanner for creating electrostatic latent images from electronically stored data in, for example, an electrophotographic printer. More specifically, the invention relates to an optical element for use in controlling the raster output scanner.

BACKGROUND OF THE INVENTION

Electrophotographic printers wherein a laser scan line is projected onto a photoconductive surface are well known. In the case of laser printers, facsimile machines, and the like, it is common to employ a raster output scanner (ROS) as a source of signals to be imaged on a pre-charged photoreceptor (a photosensitive plate, belt, or drum) for purposes of xerographic printing. The ROS provides a laser beam which switches on and off as it moves, or scans, across the photoreceptor. Commonly, the surface of the photoreceptor is selectively imagewise discharged by the laser in locations to be printed white, to form the desired image on the photoreceptor. The on-and-off control of the beam to create the desired latent image on the photoreceptor is facilitated by digital electronic data controlling the laser source. A common technique for effecting this scanning of the beam across the photoreceptor is to employ a rotating polygon surface; the laser beam from the ROS is reflected by the facets of the polygon, creating a scanning motion of the beam, which forms a scan line across the photoreceptor. A large number of scan lines on a photoreceptor together form a raster of the desired latent image. Once a latent image is formed on the photoreceptor, the latent image is subsequently developed with a toner, and the developed image is transferred to a copy sheet, as in the well-known process of xerography.

FIG. 1 shows the basic configuration of a scanning system used, for example, in an electrophotographic printer or facsimile machine. A laser source 10 produces a collimated laser beam 12 which is reflected from the facets of a rotating polygon 14. Each facet of the polygon 14 in turn deflects the laser beam 12 to create an illuminated beam spot 16 on the pre-charged surface of photoreceptor 18. The system may further include additional optical elements such as focusing lenses 15. The energy of the beam spot 16 on a particular location on the surface of photoreceptor 18, corresponding to a picture element (pixel) in the desired image, discharges the surface for pixels of the desired image which are to be printed white. In locations having pixels which are to be printed black, the beam 12 is at the moment of scanning shut off so the location on the surface of photoreceptor 18 will not be discharged. It is to be understood that grey levels are imaged in like manner by utilizing exposure levels intermediate between the "on" and "off" levels. Thus, digital data input into laser source 10 is rendered line by line as an electrostatic latent image on the photoreceptor 18.

When the beam spot 16 is caused, by the rotation of polygon 14, to move across photoreceptor 18, a scan line 20 of selectively discharged areas results on photoreceptor 18. In FIG. 1, the photoreceptor 18 is shown as a rotating drum, but those skilled in the art will recognize that this general principle, and indeed the entire invention described herein, is applicable to situations wherein the photoreceptor is a flat plate, a moving belt, or any other configuration. The surface of photoreceptor 18, whether it is a belt or drum, moves in a process direction;the motion of spot 16 through each scan line 20 is transverse to the process direction. The periodic scanning of beam spot 16 across the moving photoreceptor 18 creates an array of scan lines 20, called a raster 22, on the photoreceptor 18, forming the desired image to be printed. In real-world situations, such a configuration will typically further include any number of lenses and mirrors to accommodate a specific design.

In order for the electrostatic latent image to be successfully rendered on the photoreceptor, it is necessary that the series of scan lines 20 forming the raster 22 are properly aligned and consistently spaced from one another. The signals creating each scan line are created by the pattern of the scanning laser being modulated (turned on and off, or otherwise varied in intensity, selectively) as the beam spot 16 moves across the photoreceptor 18. Naturally, for a coherent image to be created on the photoreceptor, the time-coordination of the modulation of the beam 12 must be precise with regard to the location of the beam spot 16 on the photoreceptor 18 at any given time. When the beam spot 16 is located at a position on the photoreceptor 18 corresponding to a particular pixel forming the desired image, there must be certainty that the correct signal is output from laser source 1(::1. As the modulation of the beam spot is dictated by digital electronic data controlling the laser source 10, there must be close coordination between the laser source and the motion of the polygon surface and the photoreceptor.

This problem of coordination of data with a position of pixels in a scan line forming a raster is familiar both in the art of electrophotography and the art of television. In the electrophotographic context, various electronic or electro-mechanical schemes have been provided in the past for effecting this coordination. One of many examples of such a system is U.S. Pat. No. 4,279,002 to Rider, assigned to the assignee of the present application.

An optical element may be disposed between the light source of a scanning system and the photoreceptor surface to coordinate the imagewise digital data with the motion of a beam spot through a scan path across a photoreceptor surface. Various optical elements for use in such a context are known, although such optical elements are usually provided for purely optical correction of data scanned on the photoreceptor. U.S. Pat. No. 4,804,980 to Prakash et al. discloses an aspheric lens to be placed along the scan path of a beam spot in an electrophotographic printer. The lens exhibits varying optical power as a function of location along the longitudinal axis of the lens. The lens provides correction of tilt error and scan bow error of the beam spot through the scan path. U.S. Pat. No. 4,866,459 to Tokita et al. similarly discloses a scanning system with a lens system for the correction of images scanned onto the photoreceptor. UK Patent Publication 2 229 281A discloses an optical scanner utilizing a cylindrical lens for skew and bow correction of the beam on the photoreceptor.

U.S. Pat. No. 5,043,744 to Fantuzzo et al., assigned to the assignee of the present application, discloses an apparatus for monitoring and controlling the motion of a beam spot across a photoreceptor. The apparatus includes two photodetectors, one each disposed adjacent the photoreceptor at the start and end of the scan path, and adapted to detect an optical pattern caused by the reflection of the beam from timing marks on the moving photoreceptor. The configuration of the timing marks on the photoreceptor is adapted to permit monitoring of the "tilt" of the scan lines, i.e., the relative positions of the start and end of the scan line relative to the direction of motion of the photoreceptor.

SUMMARY OF THE INVENTION

The present invention is an optical element for the transmission of a light beam moving in a scan direction in an electrophotographic printer. A member elongated in the scan direction is adapted for the transmission of light therethrough in a direction transverse to the scan direction. An optical pattern along a portion of the member in the scan direction includes at least one surface for the non-transmission of light passing transverse to the scan direction.

In a preferred embodiment of the present invention, in a system for creating an electrostatic latent image on a photosensitive surface, including scanning means for causing a light beam from a source to move relative to the photosensitive surface in a scan path having two endpoints, and control means for modulating the intensity of the light beam in accordance with time-dependent digital data as the light beam moves relative to the photosensitive surface, the optical element is disposed between the source and the photosensitive surface and positioned along the scan path for the transmission of the light beam therethrough. The optical element defines an optical pattern in the area thereof around at least one endpoint of the scan path. Detector means is provided to sense light interacting with the optical pattern when the light beam illuminates the optical element. The apparatus coordinates the output of the digital data with the position of the light beam in the scan path.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
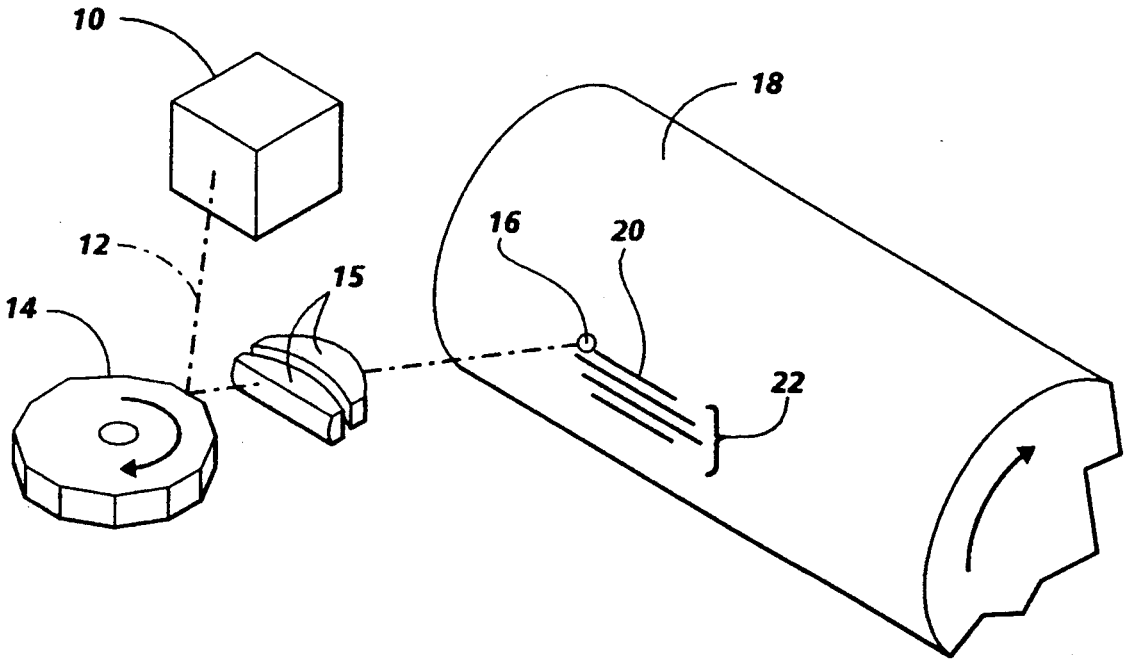
FIG. 1 PRIOR ART
FIG. 1 is a simplified elevational view showing the prior-art arrangement of elements of a scanning system.
Figure 2:
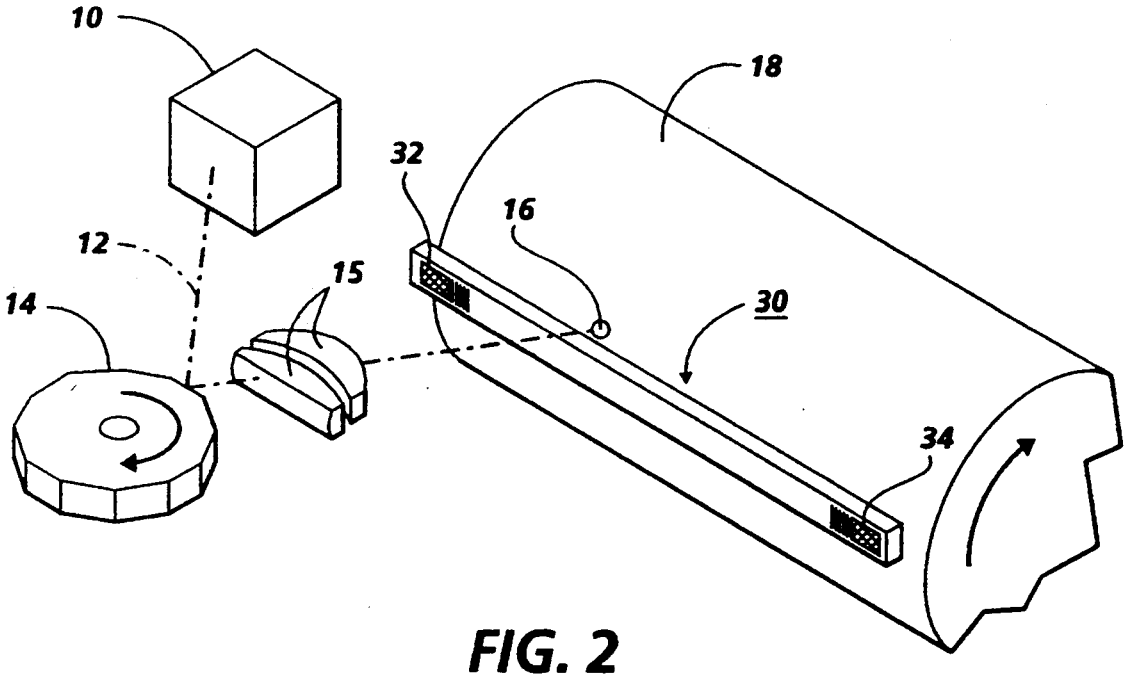
FIG. 2 is a simplified elevational view of a scanning system, incorporating the optical element of the present invention.

FIG. 2 shows an arrangement of the same basic elements of a scanning system as in the prior-art diagram of FIG. 1, with the addition of optical element 30. Optical element 30 is disposed between polygon 14 and photoreceptor 16 and arranged so that the scan path of a moving beam spot from polygon 14 will pass through the optical element 30. In this way, with the scanning of each scan line through the scan path, the entire scan line will pass through the optical element 30.

Optical element 30 is preferably a transparent or otherwise light-transmissive member generally elongated along the direction of the scan path created by the reflection of beam 12 off of polygon 14. Conceivably, the optical element 30 could be in large part tinted, polarized, imbued with a holographic image, or otherwise optically modified, as desired or needed for a particular application. At some point along the scan path of beam 16 as it passes along optical element 30, optical element 30 has defined therein at least one area 32 having an optical pattern. In the preferred embodiment of the present invention, there should be two such optical pattern areas, shown in FIG. 2 as 32 and 34. In the context of the scanner shown in FIG. 2, such areas 32 and 34 having optical patterns therein are most usefully placed at the areas along the scan direction corresponding to the end points of a scan line 20.

The optical patterns can be used to provide a real-time feedback to the scanning system for registration of successive scan lines 20 forming a raster 22 on the photoreceptor 18. Because all scan lines must pass through the optical element 30 as the scan line is made, the optical pattern 32 may be used to ensure that the first bit of digital data for a particular scan line will be output when the beam spot 16 is positioned on photoreceptor 18 for the first pixel in the scan line 20. This registration is made possible by the real-time feedback that can be created by the optical pattern 32, which is physically placed at the start of each scan line.

Figure 3A:
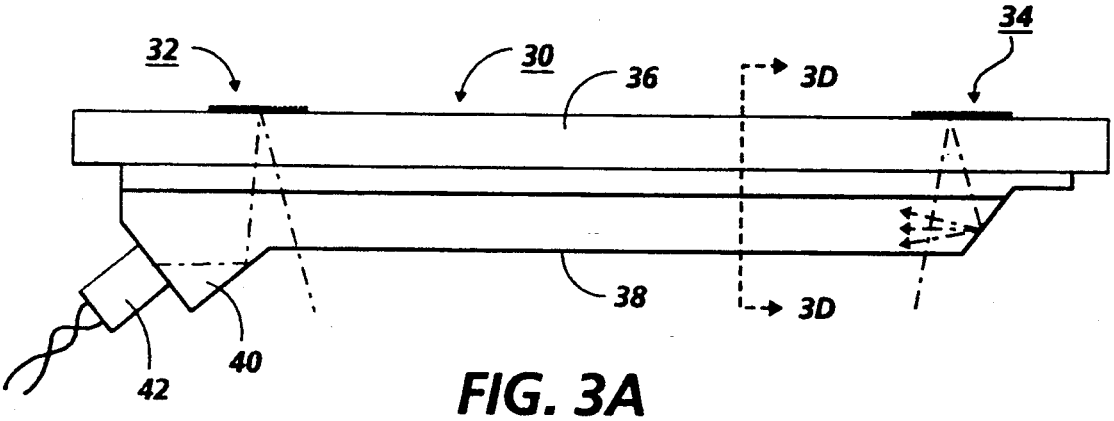
FIG. 3A is a plan view of an optical element according to the present invention.
Figure 3D:
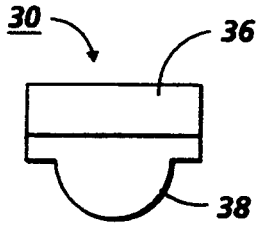
FIG. 3D is a cross-sectional view of the optical element through line 3D—3D in FIG. 3A.
Figure 3B:
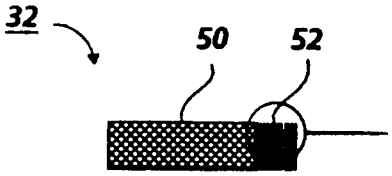
FIGS. 3B and 3C are detailed views of an optical pattern used in the optical element of the present invention.
Figure 3C:
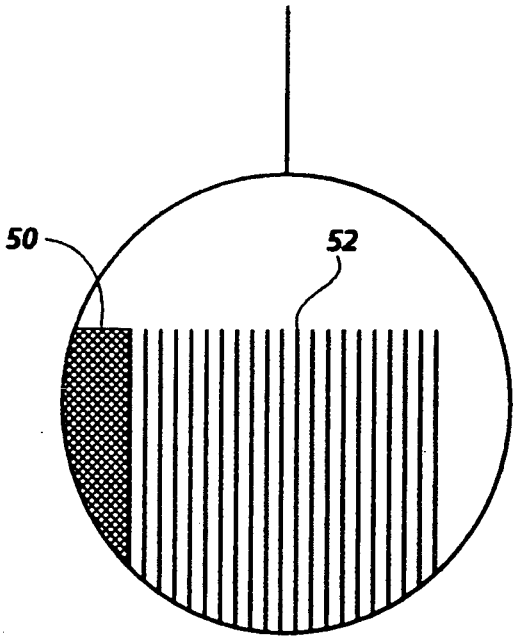

FIG. 3A is a plan view of a preferred embodiment of the optical element 30, with detailed views in FIGS. 3B and 3C showing a preferred start-of-scan pattern to be used in the context of the optical scanner shown in FIG. 2. In the preferred embodiment shown in FIG. 3A, optical element 30 can be seen to comprise a support substrate 36. The optical element 30 may also include an additional optical member 38, which may be in the form of, for example, a cylindrical or substantially cylindrical lens. Further optical members, such as prism 40 here formed as part of the member 38, may be included as well to conform to a particular design. A detector 42 is mounted in a position to detect the optical modulation of light against the optical pattern area. In the embodiment shown, the detector 42 is disposed relative to prism 40 and optical pattern area 32 in such a way that, when beam spot 16 is generally near one endpoint of its scan, the light of beam 16 will illuminate optical pattern 32, and the light reflected from optical pattern area 32 will be redirected by the internal surface of prism 40 into detector 42. Detector 42 is a photosensor adapted to supply a voltage signal in response to a detected light signal. Thus, a voltage output signal from detector 42 is generated in response to the chopped light input caused by the interaction of a moving spot 16 with the optical pattern 32. The voltage output signal, in turn, can be used in sensing means known in the art to process the voltage signal so it would be useful for the operation of, for example, the input of digital data to control either laser source 10 or polygon 14.

Turning to the optical pattern area 32, it can be seen in FIGS. 3B and 3C that the optical pattern includes an "enable" portion 50 and, on the side adjacent the main part of the optical element 30, a cyclical pattern 52. As used in the specification and claims herein, a cyclical pattern is a pattern which creates a substantially repetitive optical modulation of the input beam when a point of illumination (such as beam spot 16) is passed relative thereto. When this cyclical pattern is detected by detector 42, the electrical signal output thereof will be repetitive as well. The combination of enable portion 50 followed by cyclical pattern 52 can be used both to assure registration of scan lines 20 in raster 22, and also to control the time-dependent flow of data controlling laser source 10. Whereas the interface between enable portion 50 and cyclical portion 52 can be detected by detector 42 and used by a control system to establish the beginning of a scan line, the cyclical pattern 52 itself can be used to synchronize a pixel clock to a precise phase for controlling the timing of data into laser source 10. For example, the motion of a small spot 16 in the scan direction across the cyclical portion 52, with its alternating lines of light absorption and reflection, will cause an abrupt burst of pulses to be detected by the detector 42. The timing of individual pulses within the train is directly dependent on the actual motion of beam spot 16, which in turn is dependent on the actual motion of polygon 14. Thus, the signal from cyclical pattern 52 can provide real-time feedback to the system for supplying data to the laser source 10, much in the way an encoder roll may be used to monitor the actual mechanical motion of a rotating belt. The frequency of the voltage signal out of detector 42 caused by the modulation of beam 16 by cyclical pattern 52 can be used, for example, in a phase-locked loop to establish a clock for the further outputting of image data as the spot 16 moves across the scan path.

The embodiment of the present invention illustrated herein is directed primarily to a ROS scanning system capable of rendering a monochromatic image; that is, an image consisting of "print white" portions (where the surface of the photoreceptor is discharged) and "print black" portions (where the surface retains a charge for subsequent development). However, the present invention is also useful for more sophisticated applications, such as when two or more different colors are employed, as in a color electrophotographic printing system. Alternatively, the optical patterns may be modified as needed for coordination of multiple laser sources. For example, different surfaces of the optical pattern may be reflective or transmissive of different colors corresponding to different laser sources, to allow simultaneous and independent control of the different color sources as used, for example, in electronic photographic imaging on color sensitive film and photographic paper.

At the end of optical element 30 opposite that having detector 42, an optical pattern area 34 may be used to delineate the end of a scan path, and thus indicate to the control system the precise time that the scan line has been completed. In this case, a cyclical pattern 54, generally similar to cyclical pattern 52 in optical pattern area 32, is placed at the end of the scan line, at a point in the scan defining its end (i.e., the edge of the image is reached). Further digital data is held until polygon 14 is positioned to begin a new scan. The control system can be programmed, in the course of the exposure of a single scan line, to utilize the signal detected at detector 42 to determine the time period between start-of-scan and end-of-scan to a much greater precision than is possible when only a single edge or transition is sensed. The compound end of scan waveform is created by the interaction of beam 16 with the cyclical portion followed by a blank portion at the end of the scan, as shown at pattern area 34. As can be seen in FIG. 3, the end of member 38 may be angled as shown to provide a reflective surface such that the light reflected from pattern pattern area 34 is redirected to detector 42, using member 38 lengthwise as a light pipe.

Figure 4:
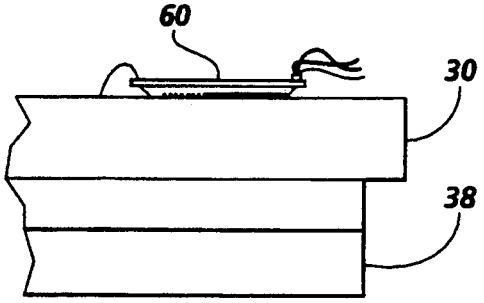
FIG. 4 is a partial plan view of an alternate embodiment of an optical element of the present invention.

FIG. 4 shows an alternate arrangement for sensing the interaction of the laser beam with an optical pattern (in this case, optical pattern area 34). Instead of the prism and detector shown in FIG. 2, a thin detector chip 60 may be cemented behind the optical pattern, so the signal is generated when the beam spot 16 passes through the interstices of the cyclical portion of the optical pattern. Such a design may be useful in the interest of compactness.

The optical pattern areas 32 or 34 generally spoken of above may be created in various ways to yield an optical pattern which will create the necessary effect when illuminated by the beam spot 16. The optical pattern may be enhanced by a light-absorbing material, such as black paint, or a light-reflecting area, such as a mirror surface.

Figure 5:
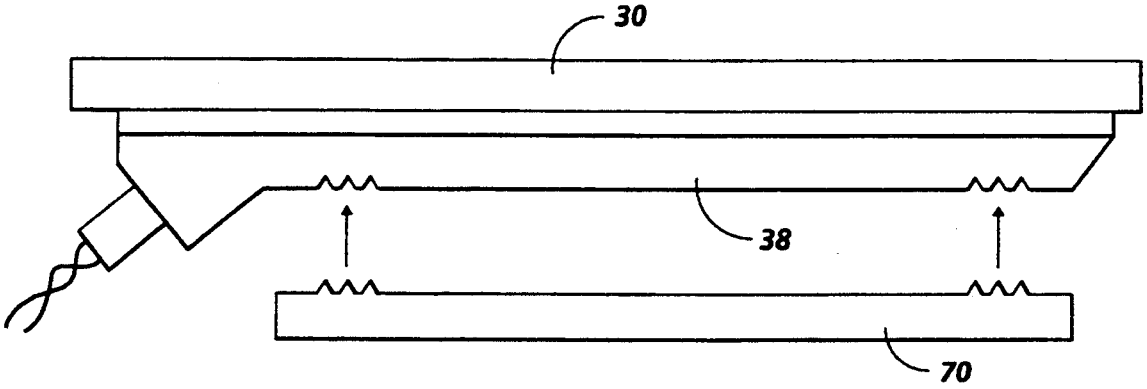
FIG. 5 is a plan view of an alternate embodiment of an optical element of the present invention.

Another technique for creating a cyclical pattern of a sufficient fineness to be useful in a scan-timing context is to emboss a series of fine grooves in the front surface of optical member 38, using, for example, an embossing tool 70 as shown in FIG. 5. By angling the walls of the grooves, the grooves can be used by themselves to redirect light from beam spot 16 to the detector 42, or black paint can be placed in the grooves to provide a light-absorbing function. Alternatively, a tinted glass or surface could be used, for example, if the detector is color-sensitive. The important feature is that a detectable signal, that can be detected by an optical detector such as 42, will be produced when beam spot 16 interacts with the optical pattern.

Figure 6A:
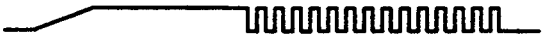
FIGS. 6A and 6B show representative electronic signals resulting from interaction of a beam spot with the optical pattern of FIG. 3B.
Figure 6B:
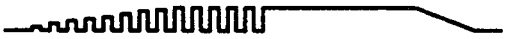

FIGS. 6A and 6B show representative signals over time that would be produced by detector 42 as a beam spot interacts with the optical patterns such as 32 (in the case of FIG. 6A) and 34 (in the case of FIG. 6B). If, for example, a reflective area in optical pattern 32 or 34 causes a fixed voltage output from detector 42, the optical patterns as a whole will cause the output of recognizable signals as shown in the Figures, wherein the short square-wave or sawtooth pattern would be caused by the areas of repetitive patterns such as 52 in FIG. 3B. The signal created by the optical pattern may be viewed as a method of facilitating very close registration of pixels similar to the "color burst" technique of signal transmission and synchronization familiar in the art of color television.

The optical element of the present invention lends itself to a factory-fixed spacing between the exact point where start of scan is defined, and the exact point where end of scan is defined. The scan length is thus rigidly defined and permanently fixed on each element manufactured. All of the optical elements of a type may be made identical because of the fabrication method, e.g., they can be made with the same embossing tool, or the same photomasks, to ensure the consistency of grooves in each optical pattern, and to ensure that the spacing between the start-of-scan and end-of-scan areas is fixed for any number of manufactured elements of a given design. This identity of a plurality of optical elements of a type enables the line length and hence transverse magnification for all colors in a multi-color architecture to be made identical in the machine. A fixed number of pixels distributed between fixed endpoints of the optical elements always yields fixed spacing, hence an identical magnification, for every optical element of a given design.

Furthermore, when the start-of-scan end is adjusted to where the start-of-scan signal comes out at the correct point on the page for horizontal color registration in color printing apparatus, the end-of-scan is automatically positioned at the correct relative distance because the start-of-scan and end-of-scan patterns are fixed to the same common optical element, and thus permanently fixed relative to each other. This is convenient when setting up a machine, because the active length of the scan passing through the element will always be constant since magnification is always defined by the length between the start-of-scan and end-of-scan patterns, which is fixed. One can, of course, arrange for a different number of pixels between the start-of-scan and end-of-scan, but this would be a deliberate and completely known change.

The present invention facilitates control of the timing of digital data in the course of creating a scan line and the exact location of the endpoints of each scan line 20 on the photoreceptor. A control system used in combination with the optical element of the present invention may be adapted to start each scan only upon a signal from the detector 42 which is attached to the optical element 30. Thus, if the optical element is physically moved lengthwise, i.e., along the direction of the scan path, the entire scan path (in terms of the digital data forming the scan path) will be precisely translated with the movement of the optical element 30, because the data for the scan line 20 will always start with the start-of-scan signal initiated by the optical pattern which is inseparable from the optical element 30 itself. The projected scan line 20, then, can be made to behave as if it were attached to the optical element 30, much like a light bar or writing head.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An optical element for the selective transmission therethrough of a light beam movable along a scan path generally transverse to the direction of the beam, the scan path having two endpoints, comprising:

a member elongated along the scan path; and a plurality of optical patterns defined along portions of the member in areas including each endpoint of the scan path, each optical pattern including at least one surface for the non-transmission of light therethrough, each optical pattern adapted to create a predetermined optical effect in response to a light beam moving along the scan path through the optical pattern, the member allowing complete transmission of the light beam therethrough along the scan path between the optical patterns, the portion of the member allowing complete transmission of the light beam being longer along the scan path than one of the optical patterns.

2. An optical element, comprising:

a light-transmissive member, elongated along an axis thereof, a portion of the member along the axis allowing complete transmission of a light beam; and an optical pattern formed in the light transmissive member at a predetermined location along the axis thereof, the optical pattern including a portion non-transmissive of light, the optical pattern adapted to create a predetermined optical effect in response to a light beam moving along the scan path through the optical pattern;

the portion of the member allowing complete transmission of the light beam being longer along the axis than the optical pattern.

3. The optical element of claim 2, wherein the portion non-transmissive of light reflects light.

4. The optical element of claim 2, wherein the portion non-transmissive of light absorbs light.

5. The optical element of claim 2, further comprising a cylinder lens attached to the light-transmissive member, the cylinder lens having an axis substantially parallel to the axis of the light-transmissive member.

6. The optical element of claim 2, further comprising a light detector disposed in a fixed position relative to the light-transmissive member adapted to receive light associated with the optical effect.

7. The optical element of claim 2, further comprising a second optical pattern formed in the light transmissive member at a second predetermined location along the axis thereof, the second optical pattern including means for the non-transmission of light.

8. The optical element of claim 7, wherein the optical pattern and the second optical pattern are each responsive to a beam spot moving through the axis of the light-transmissive member to create a predetermined optical effect.

9. The optical element of claim 8, further comprising a light detector, disposed in a fixed position relative to the light-transmissive member, adapted to receive light associated with the optical effects created by the optical pattern and the second optical pattern.

10. An image-forming apparatus, comprising:

means for causing a light beam to move through a scan path; and an optical element, including a light-transmissive member elongated along the scan path, a portion of the member along the scan path allowing complete transmission of the light beam, and an optical pattern formed in the light transmissive member at a predetermined location along the scan path, the optical pattern adapted to create a predetermined optical effect in response to the light beam moving along the scan path through the optical pattern, the portion of the member allowing complete transmission of the light beam being longer along the scan path than the optical pattern.

11. The apparatus of claim 10, further comprising a light detector, disposed in a fixed position relative to the light-transmissive member, adapted to receive light associated with the optical effect.

12. The apparatus of claim 10, further comprising a second optical pattern formed in the light transmissive member at a second predetermined location along the scan path, the second optical pattern being responsive to a beam spot moving through the axis of the light-transmissive member to create a predetermined optical effect.

13. The apparatus of claim 12, further comprising a light detector, disposed in a fixed position relative to the light-transmissive member, adapted to receive light associated with the optical effects created by the optical pattern and the second optical pattern.

* * * * *